US005251701A

United States Patent [19]

Williams et al.

[11] Patent Number: 5,251,701

[45] Date of Patent: Oct. 12, 1993

[54] METHODS AND APPARATUS FOR REMOVING DEBRIS FROM A WELL BORE

[75] Inventors: Robert M. Williams; Bob Davis, both of Hobbs, N. Mex.

[73] Assignee: Wada Ventures, N. Mex.

[21] Appl. No.: 849,981

[22] Filed: Mar. 12, 1992

[51] Int. Cl.[5] ..... E21B 10/44; E21B 37/00

[52] U.S. Cl. ..... 166/311; 166/99; 175/20; 175/323

[58] Field of Search ..... 166/311, 99, 301; 175/18, 19, 20, 323, 394, 408; 52/157

[56] References Cited

U.S. PATENT DOCUMENTS

| | | | |
|---|---|---|---|
| 3,422,913 | 1/1969 | Young, Jr. | 175/323 |
| 3,690,388 | 9/1972 | Hilton et al. | 175/323 X |
| 4,275,926 | 6/1981 | Hodges | 175/394 X |

*Primary Examiner*—Terry Lee Melius
*Attorney, Agent, or Firm*—Burns, Doane, Swecker & Mathis

[57] ABSTRACT

A well clean-out tool includes a cylindrical member in which a helical conveyor screw is arranged for vertical sliding movement relative to the cylindrical member. The tool is lowered into a well bore until the shoe contacts debris within the bore. At that time, the screw is caused to descend relative to the cylindrical member, whereupon a lower end of the screw projects slightly below a lower end of the cylindrical member, and a rotary coupling between the screw and the cylindrical member is released, and a spring is caused to store energy. Thereafter, the screw is rotated relative to the cylindrical member, while the spring presses the cylindrical member against the debris in order to resist rotation of the cylindrical member. The screw projects only slightly downwardly beyond the lower end of the cylindrical member, e.g., less than one inch, in order to convey debris upwardly within the cylindrical member. At the end of a clean-out operation, the screw is raised back into the cylindrical member whereupon the rotary coupling is re-engaged in order to produce rotation of the cylindrical member as the tool is removed from the well bore.

17 Claims, 2 Drawing Sheets

FIG. 3
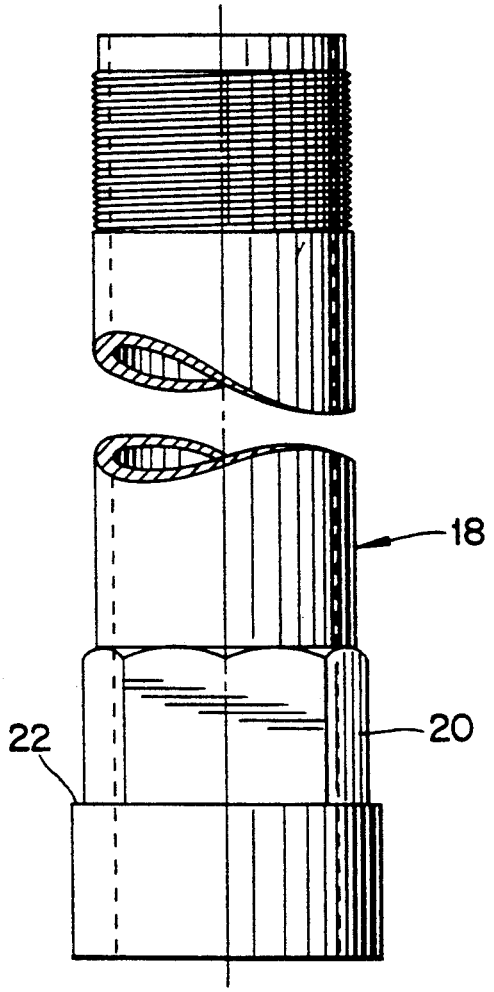
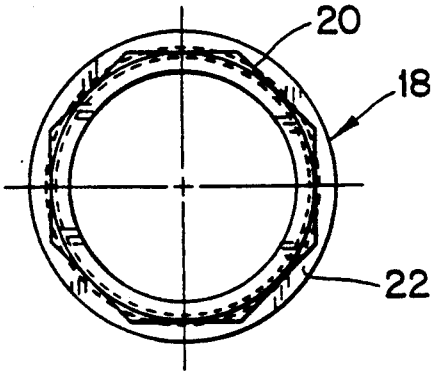
FIG. 4
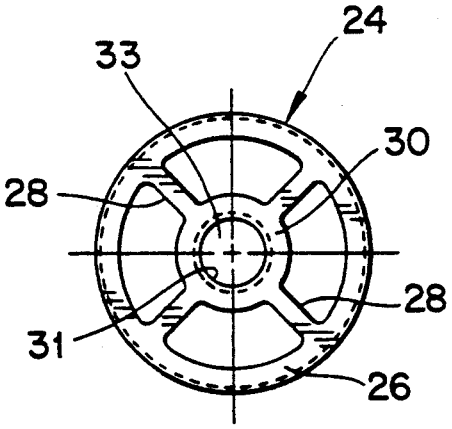
FIG. 5

METHODS AND APPARATUS FOR REMOVING DEBRIS FROM A WELL BORE

BACKGROUND OF THE INVENTION

The present invention relates to well clean-out tools and, in particular, to a well clean-out tool for removing debris from a well bore in which there is little or no standing liquid in the hole.

It is frequently necessary to remove cuttings, sand, scale and other types of debris from a well bore in order to increase the productivity and/or life of the well.

Conventional well clean-out operations, such as the circulating type or hydrostatic bailing type require that the well bore be filled with liquid or at least contain a substantial liquid column. In many instances, however, the well bore cannot sustain a substantial column of liquid for a conventional clean-out operation. Those wells, therefore, cannot be efficiently cleaned out.

It is, therefore, an object of the invention to alleviate the above-discussed shortcomings.

Another object of the present invention is to provide methods and apparatus for cleaning out a well bore which does not contain a substantial column of liquid and which cannot be cleaned out by conventional methods.

SUMMARY OF THE INVENTION

Those and other objects are achieved by the present invention which involves a well clean-out tool positionable within a well bore for removing debris therefrom. The tool comprises a cylindrical member, an auger, and a drive mechanism. The auger includes a helical conveyor screw disposed within the cylindrical member. The drive mechanism is arranged to rotate the conveyor screw relative to the cylindrical member when a lower end of the conveyor screw projects slightly downwardly below a lower end of the cylindrical member, in order to convey debris upwardly.

Preferably, the auger is slidable vertically relative to the cylindrical member such that the conveyor screw can be retracted into the cylindrical member. The auger is movable downwardly relative to the cylindrical member in response to engagement of the cylindrical member with the debris in the well bore.

The tool preferably includes a releasable coupling for transmitting rotation from the auger to the cylindrical member. That releasable coupling is released in response to downward movement of the auger relative to the cylindrical member, and is reconnected in response to upward movement of the auger relative to the cylindrical member.

The tool preferably includes a spring for urging the cylindrical member downwardly against the debris to resist rotation of the cylindrical member. That spring is arranged to store energy in response to downward movement of the auger relative to the cylindrical member.

Preferably, the conveyor screw projects downwardly below the lower end of the cylindrical member by a distance less than about one inch, most preferably in the range of three-eighths to one-half inch.

The present invention also involves a method of removing debris from a well bore. The method involves lowering into the well bore a well clean-out tool until a cylindrical member of the tool engages the debris. A helical conveyor screw disposed within the cylindrical member is caused to move downwardly relative to the cylindrical member such that a lower end of the conveyor screw projects slightly downwardly below a lower end of the cylindrical member and into the debris. Also, in response to such downward movement of the conveyor screw relative to the cylindrical member, a spring is caused to store energy, and a rotary coupling between the screw and the cylindrical member is released. The screw is rotated relative to the cylindrical member while the spring pushes the cylindrical member downwardly against the debris. Debris is thus caused to be conveyed upwardly within the cylindrical member.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 3 is a side elevational view of the slip joint portion of the tool;

FIG. 4 is an end view of the slip joint depicted in FIG. 3; and

FIG. 5 is an end view of a spider element of the tool.

DETAILED DESCRIPTION OF A PREFERRED EMBODIMENT OF THE INVENTION

Figure 1:
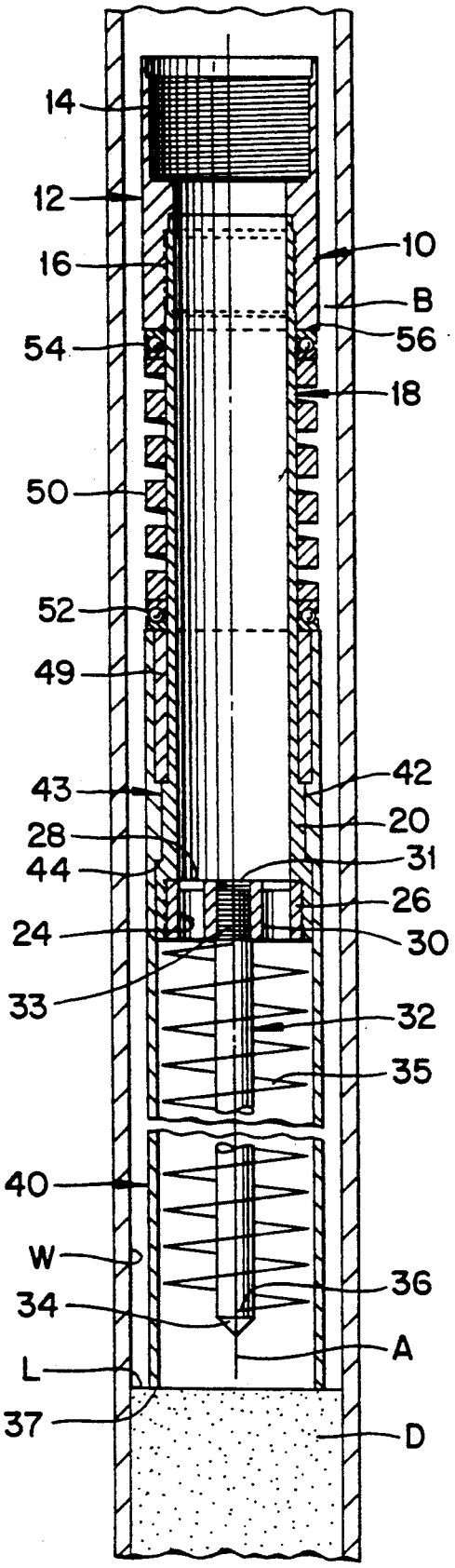
FIG. 1 is a longitudinal sectional view taken through a well clean-out tool according to the present invention, with a conveyor screw portion of the tool retracted within a shoe portion of the tool.
Figure 2:
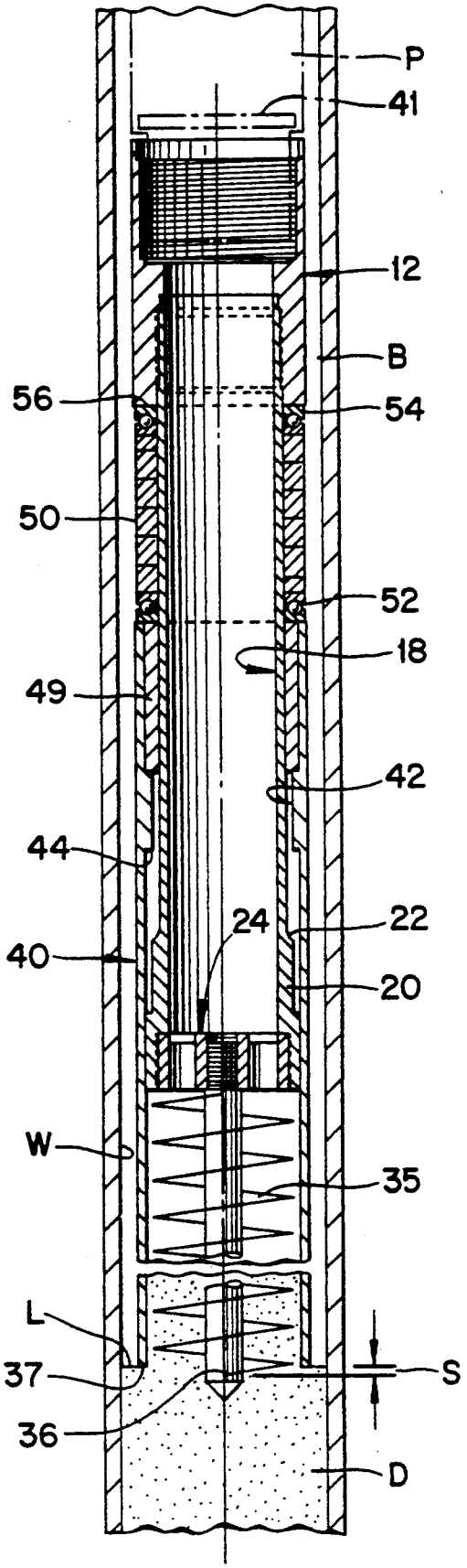
FIG. 2 is a view similar to FIG. 1 after the screw has been lowered relative to the shoe and begins to convey debris upwardly.

A well clean-out tool 10 is shown in FIGS. 1 and 2 as being disposed in a well bore B. At the bottom of the bore, debris D such as sand, scale, cuttings, etc., has collected and settled. The tool 10 comprises a top sub 12 which includes an upwardly open, screw-threaded socket 14 adapted to be attached to a tubing, such as a conventional wash pipe P (see FIG. 2). A downwardly open, screw-threaded socket 16 is provided at a lower end of the top sub for threadedly receiving the screw-threaded upper end of a slip joint sub 18.

Intermediate its ends, the slip joint sub 18 includes a non-circular outer circumferential portion 20 in the form of an octagon (see FIG. 3). Adjacent its lower end the slip joint sub 18 is provided with a radially outwardly projecting shoulder 22, and a downwardly open, screw-threaded socket 23 which receives a spider 24(see FIG. 5). The spider 24 includes a cylindrical outer skirt portion 26 which contains an external screw thread attached within the socket 23. Circumferentially spaced ribs 28 extend radially inwardly from the skirt portion 26 and, at their inner ends, carry an internally screw-threaded ring 30. The ring 30 includes a central screw-threaded hole 31 which receives a screw-threaded rod 33 of an auger element 32. The lower end 34 of the rod 33 is pointed. A helical conveyor screw 35 is provided on an outer periphery of the rod 33. The lower end 36 of the screw 35 is disposed immediately above the pointed lower end 34 of the rod 33.

The top sub 12, slip joint sub 18, spider 24, and auger element 32 together constitute an auger assembly which is rotatable as a unit about its longitudinal axis A. Disposed around the auger element 32, the spider 24, and the lower portion of the slip joint sub 18, is a cylindrical member or shoe 40.

Located intermediate its upper and lower ends the shoe 40 includes a non-circular recess 42 which is coaxial with the axis A. The recess 42 is shaped correspondingly to the outer circumferential portion 20 of the slip joint sub, i.e., is preferably octagonal, so as to be able to receive that portion 20 and define therewith a slip joint type of releasable rotary coupling 43. That is, when the portion 20 of the slip joint sub 18 is disposed within the recess 42, the shoe 40 and auger assembly are interlocked for common rotation. In response to axially downward sliding movement of the auger assembly relative to the shoe, the portion 20 leaves the recess 42 to release the rotary coupling.

Disposed adjacent the lower end of the recess 42, the shoe 40 includes a radially inwardly extending shoulder 44 adapted to engage the shoulder 22 of the slip joint sub 18 for transmitting upward forces from the auger assembly to the shoe. Hence, when the auger assembly is being run into, or pulled from, the well bore, the shoe 40 will be carried on the shoulder 22.

At its upper end, the shoe 40 includes an internal socket which receives a bushing 49, e.g., a cylindrical brass bushing.

Operably disposed between the shoe 40 and the auger assembly is a biasing spring 50. The spring 50 comprises a coil compression spring which is seated between two rotary bearings 52, 54. A lower one of the rotary bearings 52 sits upon upper ends of the shoe 40 and bushing 49. The other, upper bearing 54 is disposed between an upper end of the spring 50 and a downwardly facing radial shoulder 56 of the top sub 12. The bearings 52, 54 permit the auger assembly to rotate relative to the shoe 40 for reasons to be explained.

The spring 50 is of sufficient strength to normally bias the auger assembly upwardly to cause the shoulders 22, 44 to interengage. In such a state, the auger element 32 is held in a retracted position within the shoe 40. It is in this condition that the tool 10 is run into the well bore B with the auger assembly rotating. When the shoe sets down upon the accumulated debris D, the weight of the tubing pushes the auger assembly 12, 18, 24, 32 downwardly relative to the shoe 40 while simultaneously compressing the spring 50, until eventually the spring 50 bottoms out as depicted in FIG. 2. In that state, the pointed end 34 of the rod 33 and the lower end 36 of the screw 35 project downwardly beyond the lower end 37 of the shoe and into the debris. Also, the portion 20 of the slip joint sub will have exited the recess 42, thereby releasing the rotary connection between the auger assembly and the shoe 40 so that the shoe 40 stops rotating even as the auger assembly continues to rotate.

The lower portion of the rotating screw 35 which projects downwardly from the shoe 40 by a slight distance S, rotates through the debris and coveys it upwardly through the shoe 40, the spider 24, the slip joint sub 18 and eventually into the wash pipe P connected at the upper end of the top sub 12. It is only necessary that the screw 35 project downwardly from the shoe 40 by a slight distance, e.g., distance S being less than about one inch, more preferably three-eighths to one-half inch, in order for the debris to be conveyed by the screw.

As the debris is conveyed upwardly, the level L of the debris in the well bore B goes down, causing the shoe 40 and auger element 32 to descend. It is necessary that the bottom of the shoe 40 be fixed against rotation and remain in close proximity to the lower end of the auger element 32 in order for the debris to be continually conveyed. The downward pressure from the spring 50 pushing the shoe 40 against the debris will hold the shoe 40 against rotation and will keep the bottom of the shoe 40 in close proximity to the bottom 36 of the screw 35.

Once the debris has been fully removed, or the washpipe has been sufficiently filled, the tubing is lifted to cause the auger assembly to rise relative to the shoe. The spring 50 aids in ensuring that the auger assembly rises relative to the shoe by imposing a downward force on the shoe. As a result of such upward movement of the auger assembly relative to the shoe, the portion 20 of the slip joint sub 18 re-enters the recess 42 to rotatably couple the auger assembly to the shoe. The shoe is thus rotated to aid in pulling the tool from the debris.

In operation, the tool 10 is lowered on a tubing or the like until the shoe 40 contacts the debris D. At this point, both the auger assembly 12, 18, 24, 32 and the shoe 40 are rotating. When the shoe 40 engages the debris, further downward movement thereof is resisted. (Although the bottom end of the shoe 40 is depicted in FIG. 1 as lying on the top surface L of the debris D, the shoe may descend to some depth into the debris, depending upon the density of the debris.) The weight of the tubing then causes the auger assembly to descend relative to the shoe, until the auger element projects downwardly beyond the lower end 37 of the shoe 40 (see FIG. 2).

During such downward movement of the auger assembly relative to the shoe, the spring 50 becomes compressed and eventually bottoms out to limit the downward distance which the auger assembly may travel relative to the shoe.

As the auger assembly descends relative to the shoe 40, the slip joint 43 is disengaged so that the rotary connection between the auger assembly and shoe is terminated, causing the rotation of the shoe 40 to cease.

As the auger screw 35 rotates relative to the shoe 40, the screw conveys debris upwardly within the stationary shoe 40, and the debris eventually passes upwardly from the top sub 12 into the wash pipe P which has a conventional one-way swingable flap valve 41 at its lower end to prevent backflow of the debris. The spring 50 presses the shoe downwardly against the debris to resist a tendency for the shoe to be rotated by frictional forces applied by the debris being conveyed therein.

As the debris is removed from the well bore B, the level L of the debris descends, and the tool 10 descends along with it. Any possibility that the shoe will fail to descend with the auger assembly (e.g., due to frictional contact with the side W of the well bore), is prevented by the downward force from the spring 50.

Eventually, when the debris has been removed, and/or the wash pipe P has been filled, the tool is removed from the well bore by lifting the tubing. This produces upward movement of the auger assembly relative to the shoe 40 (aided, if necessary, by the downward force from the spring 50 acting on the shoe), whereupon the release joint 43 is re-coupled to enable the rotary force to be transmitted from the auger assembly to the shoe 40. Rotation of the shoe is useful in helping to free the shoe from the debris.

It will be appreciated that the present invention provides a tool for efficiently removing debris from a well bore in the absence of a substantial liquid column within the bore. As a result, wells which previously could not be cleaned now can be. The tool is of relatively simple construction and can be easily operated.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims:

What is claimed is:

1. A well clean-out tool positionable within a well bore for removing debris therefrom, comprising:
   a cylindrical member;
   auger means including a helical conveyor screw disposed within said cylindrical member;
   drive means for rotating said conveyor screw relative to said cylindrical member with a lower end of said conveyor screw projecting slightly downwardly below a lower end of said cylindrical member, for conveying debris upwardly; and
   a releasable coupling for transmitting rotation from said auger means to said cylindrical member.

2. A well clean-out tool positionable within a well bore for removing debris therefrom, comprising:
   a cylindrical member;
   auger means including a helical conveyor screw disposed within said cylindrical member, said conveyor screw being slidable vertically relative to said cylindrical member for being retracted into said cylindrical member; and
   drive means for rotating said conveyor screw relative to said cylindrical member with a lower end of said conveyor screw projecting slightly downwardly below a lower end of said cylindrical member, for conveying debris upwardly.

3. A well clean-out tool according to claim 2, wherein said auger means is movable downwardly relative to said cylindrical member in response to engagement of said cylindrical member with debris in the well bore.

4. A well clean-out tool according to claim 2 including a releasable coupling for transmitting rotation from said auger means to said cylindrical member.

5. A well clean-out tool according to claim 4, wherein said releasable coupling is released in response to downward movement of said auger means relative to said cylindrical member, and re-connected in response to upward movement of said auger means relative to said cylindrical member.

6. A well clean-out tool according to claim 5 including biasing means for urging said cylindrical member downwardly against the debris to resist rotation of said cylindrical member.

7. A well clean-out tool according to claim 6, wherein said biasing means is arranged to store energy in response to downward movement of said auger means relative to said cylindrical member.

8. A well clean-out tool according to claim 7, wherein said biasing means comprises a spring operably disposed between said auger means and said cylindrical member.

9. A well clean-out tool according to claim 5, wherein said releasable coupling comprises a non-circular recess in said cylindrical member, and a non-circular projection on said auger means which is slidable into and out of said recess in response to relative up and down movement of said auger means relative to said cylindrical member.

10. A well clean-out tool according to claim 2, wherein said conveyor screw projects downwardly below said lower end of said cylindrical member by a distance less than about one inch.

11. A well clean-out tool according to claim 10, wherein said distance is in the range of three-eighths to one-half inch.

12. A well clean-out tool positionable within a well bore for removing debris therefrom, comprising:
   a cylindrical member;
   auger means including a helical screw disposed coaxially within said cylindrical member, said auger means and cylindrical member being axially movable relative to one another such that said auger means moves downwardly relative to said cylindrical member when the tool engages debris to enable a lower end of said screw to project slightly beyond a bottom end of said cylindrical member;
   spring means for storing energy in response to said downward movement of said auger means relative to said cylindrical member and for imposing a downward force on said cylindrical member;
   drive means for rotating said auger means; and
   a releasable coupling for transmitting rotation from said auger means to said cylindrical member.

13. A well clean-out tool according to claim 12, wherein said releasable coupling is arranged to be released in response to said downward movement of said auger means relative to said cylindrical member, and reconnectable in response to upward movement of said auger means relative to said cylindrical member.

14. A well clean-out tool according to claim 13, wherein said releasable coupling comprises a slip joint.

15. A well clean-out tool according to claim 14 wherein said spring means comprises a helical spring positioned between said cylindrical member and said auger means; a first rotary bearing being disposed between a lower end of said spring and said cylindrical member; and a second rotary bearing being disposed between an upper end of said spring and said auger means.

16. A well clean-out tool according to claim 12, wherein said screw projects beyond said bottom end of said cylindrical member by a distance less than about one inch.

17. A well clean-out tool according to claim 16, wherein said distance is in the range of three-eighths to one-half inch.

* * * * *